US005986402A

United States Patent [19]

Narita et al.

[11] Patent Number: 5,986,402

[45] Date of Patent: Nov. 16, 1999

[54] METAL HALIDE LAMP

[75] Inventors: Mitsuo Narita; Akihiko Sugitani; Yoshihiro Horikawa, all of Himeji; Takashi Ito, Tatsuno; Tatsushi Igarashi, Himeji, all of Japan

[73] Assignee: Ushiodenki Kabushiki Kaisha, Tokyo, Japan

[21] Appl. No.: 08/961,262

[22] Filed: Oct. 30, 1997

[30] Foreign Application Priority Data

Oct. 31, 1996 [JP] Japan ..... 9-304127

[51] Int. Cl.[6] ..... H01J 17/06

[52] U.S. Cl. ..... 313/620; 313/621

[58] Field of Search ..... 313/631, 632, 313/574, 620, 621

[56] References Cited

U.S. PATENT DOCUMENTS 5,239,230 8/1993 Mathews et al. ..... 313/620

5,723,944 3/1998 Higashi et al. ..... 313/631

*Primary Examiner*—Michael Day

*Attorney, Agent, or Firm*—Sixbey, Friedman, Leedom & Ferguson; David S. Safran

[57] ABSTRACT

A metal halide lamp with a distance of less than 3.0 mm between the electrodes, in which in the hermetically sealed portion no cracks occur, which can be produced without difficulty, and which enables advantageous operation is achieved with a halide lamp in which an arc tube made of quartz glass contains a cathode and an anode spaced from each other at a distance of less than or equal to 2.9 mm together with mercury and metal halides, and which is operated with a nominal wattage range of from 100 to 400 W using direct current, by causing the ratio D/H to be greater than or equal to 1.9 when D is the maximum inside diameter in millimeters in a direction which orthogonally intersects the axial direction of the electrodes in the discharge space and H is the length of the cathode projecting within the discharge space, also in millimeters.

6 Claims, 3 Drawing Sheets

| Lamp | Nominal wattage (W) | D (mm) | H (mm) | D/H | Inter-electrode distance (mm) | Crack formation |
|---|---|---|---|---|---|---|
| 1 | 250 | 9.2 | 5.8 | 1.59 | 2.6 | present |
| 2 | 250 | 11.0 | 5.8 | 1.89 | 2.8 | slightly present |
| 3 | 125 | 8.7 | 3.5 | 2.48 | 2.5 | absent |
| 4 | 250 | 11.0 | 4.6 | 2.39 | 2.8 | absent |
| 5 | 250 | 9.2 | 6.5 | 1.41 | 2.6 | present |

FIG. 5

METAL HALIDE LAMP

BACKGROUND OF THE INVENTION

1. Field of the Invention

The invention relates to a metal halide lamp. The invention especially relates to a metal halide lamp of the short arc type which is suitable for a liquid crystal projector or the like, and which is operated using a direct current.

2. Description of Related Art

Liquid crystal projectors have recently become more and more important. A metal halide lamp of the short arc type is used for their light source. This light source consists of a metal halide lamp (hereinafter called only "lamp") and a concave reflector. It is formed by embedding one of the hermetically sealed portions of this lamp in the base opening of the concave reflector using a filler material in the state in which the lamp axis and the optical axis of the concave reflector agree with one another, or by similar processes.

The light emitted from the lamp is emitted directly or by reflection from the concave reflector onto an optical system such as a focussing lens and the like. The light which has passed through this optical system irradiates a liquid crystal cell. The image formed on the liquid crystal cell is projected via a projection lens onto a screen.

The metal halide lamp has hermetically sealed ends on both sides (is the so-called "double end type"). Its discharge space contains a cathode and an anode, mercury as the starting rare gas and various metal halides.

In this metal halide lamp, as a result of vaporization of the metal halides, a sufficient vapor pressure is obtained at a lower temperature than is the case when using metal elements. The radiant efficiency is higher than in a high pressure mercury lamp. In addition, by a suitable choice of the metals to be filled, outstanding color reproduction can be obtained. Therefore, the metal halide lamp is regarded as an optimum choice for use as a light source for a liquid crystal projector.

With consideration of the continuing miniaturization of liquid crystal projectors, and thus the miniaturization of the liquid crystal cell, there is a demand for a shorter distance between the electrodes of the lamp than in conventional cases in order to sufficiently focus the radiant light from the metal halide lamp on the liquid crystal cell.

Specifically, the distance between the electrodes in a conventional metal halide lamp was 3.0 mm to 5.0 mm. However, this requirement for miniaturization dictates that the distance between the electrodes be less than 3.0 mm.

With respect to this requirement for shortening of the distance between the electrodes, however, the follow disadvantages arise when only two electrodes are allowed to project into the discharge space:

In operation of the metal halide lamp, not all of the metal halides are completely vaporized, the metal halides being present in the discharge space partially as solids and partially as liquids. The metal halides in this solid state or liquid state collect during lamp operation on the coolest site (at the point with the lowest temperature) in the discharge space.

When the electrodes project into the discharge space, the temperature of the base points of these electrodes become, accordingly, lower until it reaches the coolest point. The metal halides in the solid state or the liquid state therefore collect in these base points. In doing so, the base point of the cathode represents the coolest part, since the anode generally has a higher temperature than the cathode.

The metal halides which have collected at this base point of the cathode penetrate the hermetically sealed portion into a very narrow gap which has formed between the cathode rod and the quartz glass. In this hermetically sealed portion, cracks occur due the effect of expansion and contraction and the like when the lamp is turned on and off.

With respect to the requirement for a shortening of the distance between the electrodes, a process can furthermore be theoretically imagined in which the entire discharge space is made smaller (i.e. a process for miniaturization while maintaining similarity). From the hermetically sealed portion, however, a certain size is necessary from a production standpoint. The hermetically sealed portions, in the case of a distance between the electrodes of less than 3.0 mm, are rather small. Production thereof entails major difficulties which could not be imagined in a conventional lamp.

Furthermore, the lamp can no longer be advantageously operated when, during operation, its tube wall load is not kept within a stipulated numerical range. Therefore, miniaturization of the discharge space is regarded as disadvantageous in conjunction with the tube wall load.

SUMMARY OF THE INVENTION

In view of the foregoing, a primary object of the present invention is to devise a metal halide lamp, with a distance between the electrodes of less than 3.0 mm, in which no cracks occur in the hermetically sealed portions.

In conjunction with the preceding object, it is a further object to device such a metal halide lamp which can be produced without difficulty, and which, furthermore, enables advantageous operation.

These objects are achieved in a metal halide lamp in which an arc tube consisting of quartz glass encloses a cathode and an anode at a distance of less than or equal to 2.9 mm relative to one another, together mercury and metal halides, and which is operated with a nominal wattage in the range from 100 to 400 W using a direct current. The objects are also achieved by causing a ratio of the maximum inside diameter in the direction which orthogonally intersects the axial direction of the electrode in the discharge space, D (mm), to the length of the cathode projecting in this discharge space, H (mm), to have a value which is greater than or equal to 1.9, i.e., $D/H \geqq 1.9$.

The object is also achieved by the discharge space having essentially the shape of an elliptical body of revolution and by the arc center being positioned, proceeding from the middle position of its major axis, on the cathode side.

The object is achieved, moreover, by the discharge space having essentially the shape of an elliptical body of revolution and by the tip of the anode being positioned, proceeding from the middle position of its major axis, on the cathode side.

In the following, the invention is further described using several embodiments shown in the drawings.

BRIEF DESCRIPTION OF THE DRAWINGS

FIG. 5 shows a table of specific numerical examples of the lamp and the formation of cracks.

DETAILED DESCRIPTION OF THE PREFERRED EMBODIMENTS

Figure 1:
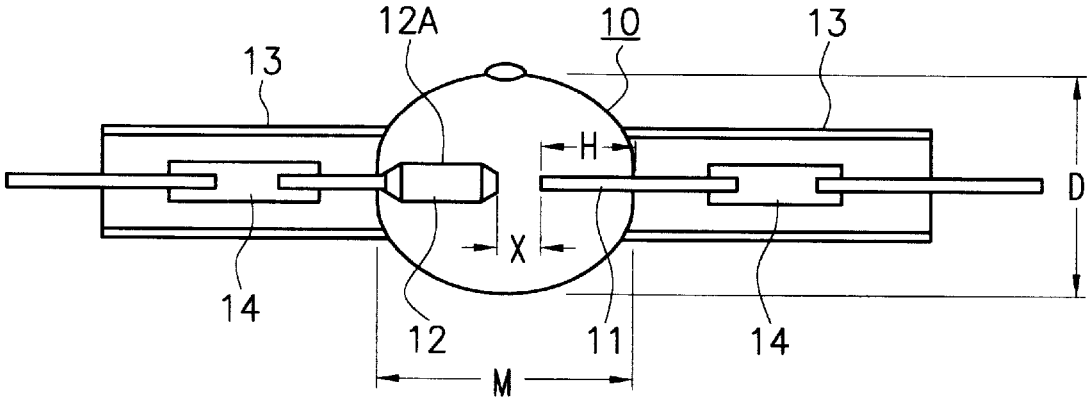
FIG. 1 is a schematic illustration of a metal halide lamp in accordance with an embodiment of the invention.

FIG. 1 is a schematic of the metal halide lamp in accordance with a preferred embodiment of the invention. An arc tube 10 encloses a discharge space which is an elliptical body of revolution formed around a major axis (i.e., the axial direction of the electrodes) and the arc tube 10 is formed of quartz glass with a thickness of 1.5 mm. Arc tube 10 has an inside diameter M with respect to the major axis (i.e., maximum diameter in the axial direction of the electrodes) of 16.0 mm and an inside diameter D with respect to the minor axis (i.e., the maximum diameter in the direction which orthogonally intersects the axial direction of the electrodes) of 14.5 mm and an interior volume of 0.8 cc.

A cathode 11 and an anode 12 are located within the quartz glass arc tube 10. Cathode 11 is made of a tungsten rod with an outside diameter of 0.6 mm and a total length of 11.0 mm. Anode 12 is formed of a tungsten rod which has an electrode head 12A at the tip with an outside diameter of 0.6 mm and a total length of 7.0 mm. Electrode head 12A is a cylinder with an outside diameter of 2.2 mm and a length of 5.0 mm, the two ends of which are rounded off. A distance X exists between the facing ends of the cathode 11 and anode 12, i.e. the distance between the electrodes (or the arc length), is less than or equal to 2.9 mm.

Cathode 11 and anode 12 are each connected to a respective metal foil 14 made of molybdenum and which is cemented to a respective hermetically sealed portion 13. Each metal foil 14 is connected to an outer lead pin on an end of the foil which is opposite that at which it is connected to the respective electrode, i.e., cathode 11 or anode 12.

Besides mercury, one or more metals of the rare earths are provided in the discharge space as emission metals, for example, Dy (dysprosium), Nd (neodymium), Tl (thallium), In (Indium), Sn (tin), Cs (cesium) and the like in the form of an iodide or bromide. Furthermore, the arc tube is filled with argon gas as the starting rare gas. The substances with which the arc tube 10 is filled are, for example, 30.0 mg of mercury, 0.2 mg of a mixture of halides of the rare earths including dysprosium iodide and cesium iodide, 0.1 mg of indium iodide and 150 torr of argon at room temperature.

In this embodiment, the metal halide lamp is operated, for example, with a nominal wattage of 250 W and a nominal current of 4.5 A. Furthermore, the metal halide lamp as of the invention is operated in a horizontal orientation using a direct current. The reason for this is to reduce the number of ions or atoms of the rare earths or neutral atoms which reach the arc tube by attracting the ions or atoms of the rare earths in the direction to the cathode. This yields the advantage that milky opacification of the arc tube can be greatly reduced by positive use of the polarization phenomenon of the emission substances (of the cataphoresis phenomenon).

In this case, according to the invention, a ratio D/H of the length H of the projection of cathode 11 to the maximum inside diameter D in the direction which orthogonally intersects the axial direction of the electrode is fixed at greater than or equal to 1.9. For this purpose, the expression "length of the projection" is defined as the length of the cathode which projects into the discharge space, the part of the cathode which is located in hermetically sealed portion 13 being excluded. This length of the projection is labelled H in the drawing and is, for example, 4.6 mm.

The inventors have found that no cracks occur in the hermetically sealed portion of the cathode of a metal halide lamp if the distance X between the electrodes is less than or equal to 2.9 mm, the lamp is operated using a direct current and the relationship D/H, between the length H (mm) of the cathode projection and the maximum diameter D (mm) in the direction which orthogonally intersects the axial direction of the electrode, is fixed at greater than or equal to 1.9.

The reason for this is the following:

Adhesion of the not yet vaporized metal halides to the base point of the cathode occurs, generally, because the base point of the cathode in the discharge space is the coolest location, as described above. First of all, by reducing the length of the projection of the cathode, the coolest point is shifted to another location (preferably to the center area of the arc tube wall). In this way, the point at which the not yet vaporized metal halides adhere is moved to the above described other location.

If, on the other hand, the length of the projection of the cathode is extremely reduced, conversely, the temperature of the base point of the cathode is high. Furthermore, if the location in the discharge space at which the arc is formed is in the immediate vicinity of the base point of the cathode, an adverse effect occurs with respect to the optical system as well. Additionally, here, the base point of the anode is shifted to the coolest point; this may engender the disadvantage of crack formation in the hermetically sealed portion on the anode side. Also, experience shows that lamp emission is generally bright when the length of the projection of the cathode is large.

The inventors have considered the aforementioned factors and conducted vigorous research. As a result, they noticed the relation between the length H (mm) of the projection of the cathode and the maximum diameter D (mm) in the direction which orthogonally intersects the axial direction of the electrode in the discharge space, and they found a range of numerical values with which the coolest point is not produced at the base point of the cathode.

Figure 2:
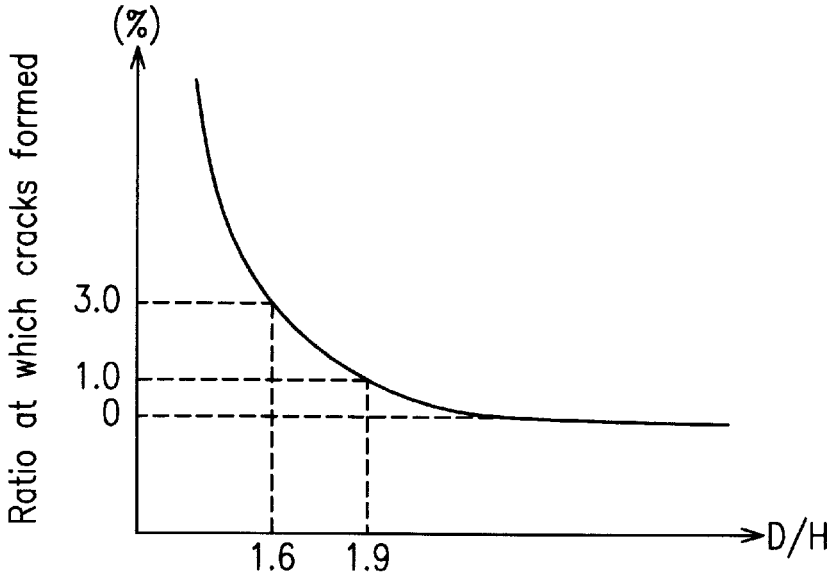
FIG. 2 is a graph showing the relationship between the value of the ratio D/H between the maximum diameter in the direction which orthogonally intersects the axial direction of the electrode, D, and the length of the projecting cathode, H and the percentage of cracks formed in the hermetically sealed portion on the cathode side.

FIG. 2 is a schematic of the relation between the value of ratio D/H and the ratio of crack formation in the hermetically sealed portion on the cathode side, the length of the projection of the cathode being labelled H and the maximum diameter in the direction which orthogonally intersects the axial direction of the electrode in the discharge space being labelled D. In the drawings the Y-axis plots the frequency (%) of crack formation and the X-axis the value of D/H.

The expression "frequency of crack formation" is defined as the ratio of the number of lamps in which cathode cracks have formed in the hermetically sealed portion of the lamps when the lamps have been operated for 500 hours with regard to the respective value of D/H. Here, the expression "crack formation" is defined as the number of all lamps in which extremely small cracks have formed and which furthermore broke due to crack formation.

The relation shown in the FIG. 2 illustrates that the frequency of crack formation is greater, the smaller the value of D/H. Furthermore, it becomes apparent that the frequency of crack formation is less, the greater the value of D/H. Specifically, the formation frequency is 3.0% if D/H is 1.6. If D/H is 1.9, the frequency of occurrence is 1.0%. Moreover, it is shown that the frequency of crack formation is essentially 0% when D/H is greater than 1.9.

As was described above, crack formation in fact means a defect of the lamp. This means that an increase of cracking frequency above 1.0% is critical in a negative sense.

According to the invention the nominal wattage of the metal halide lamp is limited to 100 to 400 W. The reason for this is the following:

When a nominal wattage of less than or equal to 100 W is utilized, the brightness is insufficient for use of the lamp as the light source for an actual liquid crystal projector. Furthermore, in operation with a nominal wattage of greater than or equal to 400 W, power consumption is too high; this entails problems on the production plane of the liquid crystal projectors.

Furthermore, the metal halide lamp according to the invention is characterized in that the arc center is shifted towards the cathode side relative to the center of the major axis (the inside diameter in the axial direction of the electrode) of the discharge space in the form of an elliptical body of revolution.

Figure 3:
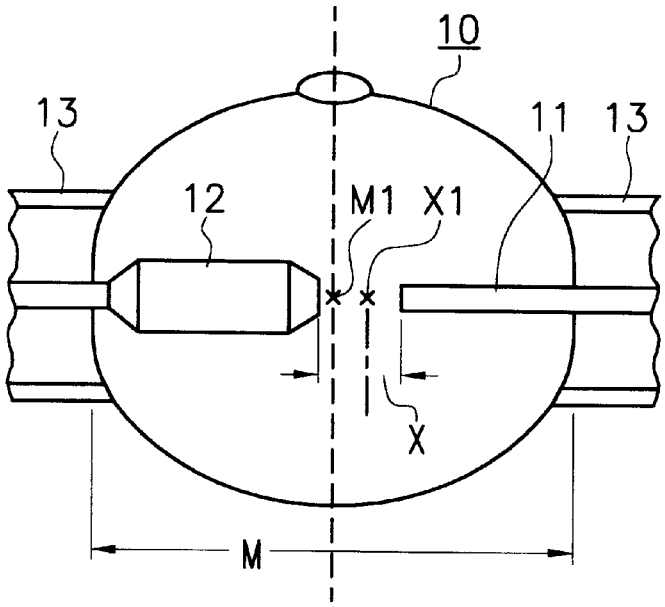
FIG. 3 shows one configuration of the electrodes in the discharge space of metal halide lamp in accordance with the invention.

FIG. 3 shows one specific example hereof. In this case, center position X1 of the arc (i.e. the center position of distance X between the electrodes) is shifted from the center M1 of the major diameter M of the discharge space towards the cathode side.

In addition, the metal halide lamp of the invention is characterized in that the tip of the anode is positioned on the cathode side relative to the center of the major axis (the inside diameter in the axial direction of the electrode) of the discharge space formed of an elliptical body of revolution.

Figure 4:
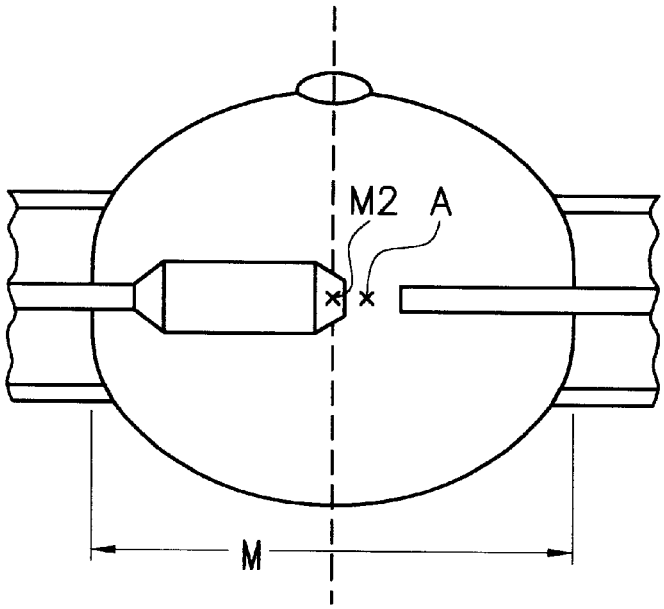
FIG. 4 shows another configuration of the electrodes in the discharge space of the metal halide lamp as of the invention.

FIG. 4 illustrates one specific example hereof. In this case, tip A of anode 12 is positioned on the cathode side relative to the center M2 of the major diameter M of the discharge space.

The embodiments shown in FIGS. 3 and 4 represent specific arrangements which are formed to implement the metal halide lamp of the invention. In these embodiments, lamps were described in which the discharge space has the shape of an elliptical body of revolution; but, the discharge space is not limited to this shape, and the lamps can, if necessary, which have discharge spaces in the shape of a ball, oval or the like.

Length H of the projection of the cathode is not limited, if D/H is greater than or equal to 1.9, as was described above. But, as it is associated with the nominal wattage and the distance between the electrodes, it is, in fact, less than or equal to 5.0 mm.

In the metal halide lamp of the invention, the arrangement of the hermetically sealed portions is not limited, i.e. they can have an arrangement with a pinch seal, a shrink seal, and the like. Furthermore, the cross-sectional shape of the hermetically sealed portions is not limited. They can have different shapes, such as with a circular shape, platform, an essentially H-shape, or the like.

FIG. 5 shows specific numerical examples and the formation or nonformation of cracks in five lamps from the lamps used in the tests from which the graph shown in FIG. 2 was derived. The nominal wattage and the distance between the electrodes in all lamps is in the range of numerical values noted above, i.e. the nominal wattage is 100 to 400 W and the distance between the electrodes is less than or equal to 2.9 mm. Comparisons were made and described between the lamps with values of D/H of greater than or equal to 1.9, i.e. in the range which was determined to be desirable in accordance with the invention and in the lamps with different values.

As the Table shows, in lamps 1 and 5 in which the value of D/H is less than 1.9, the clear formation of cracks is confirmed. Furthermore, in lamp 2 in which the value of D/H is slightly less than 1.9, formation of cracks which are so small that they cannot be seen is confirmed. In the other lamps, i.e. in lamps 3 and 4, in which the value of D/H exceeds 1.9, it was confirmed that no cracks were formed.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Action of the invention

With the metal halide lamp of the invention, a lamp which has a distance between the electrodes of less than or equal to 2.9 mm, and which is operated using a direct current, can be advantageously operated without crack formation in the hermetically sealed portion of the cathode.

We claim:

1. A metal halide lamp comprising an arc tube made of quartz glass within which there are provided a cathode and an anode positioned with a distance from each other of less than or equal to 2.9 mm, mercury and metal halides, and which is operable by a direct current power source at a nominal wattage in the range from 100 to 400 W;

wherein a ratio D/H is greater than or equal to 1.9 when D is a maximum inside diameter of the arc tube in a direction which orthogonally intersects an axial direction of the cathode and anode in the discharge space (mm) and H is a total length of the cathode that is located within the discharge space (mm).

2. Metal halide lamp as claimed in claim 1, wherein the discharge space has an essentially elliptical cross-sectional shape; and wherein the cathode and the anode are positioned relative to each other in a manner causing an arc center to be positioned on a cathode side relative to a center position of a major axis of the discharge space.

3. Metal halide lamp as claimed in claim 2, wherein the discharge space has essentially an elliptical cross-sectional shape; and wherein a tip of the anode is positioned on the cathode side relative to the center position of the major axis of the discharge space.

4. Metal halide lamp as claimed in claim 1, wherein the anode is formed of a tungsten rod which has an enlarged electrode head at an inner end thereof, said electrode head being in the form of a cylinder the two ends of which are rounded off.

5. Metal halide lamp as claimed in claim 4, wherein the cathode and the anode are each connected to a respective metal foil which is fixed within a respective hermetically sealed portion; and wherein each metal foil is connected to an outer lead pin on an end of the metal foil which is opposite an end of the metal foil that is connected to the respective one of the cathode and anode.

6. Metal halide lamp as claimed in claim 1, further comprising a direct current power source coupled between the cathode and the anode and producing an arc therebetween at a nominal wattage in the range from 100 to 400 W.

* * * * *